US007244166B1

(12) United States Patent
Sherman et al.

(10) Patent No.: US 7,244,166 B1
(45) Date of Patent: Jul. 17, 2007

(54) TOY AND PACIFYING DEVICE FOR INFANTS

(76) Inventors: Krissa Sherman, 430 Rising Sun Rd., Bailey, CO (US) 80421; Georgia Gueck, 3234 S. Ivy Way, Denver, CO (US) 80222-7545

( * ) Notice: Subject to any disclaimer, the term of this patent is extended or adjusted under 35 U.S.C. 154(b) by 216 days.

(21) Appl. No.: 10/262,568

(22) Filed: Sep. 30, 2002

Related U.S. Application Data

(60) Provisional application No. 60/326,433, filed on Oct. 1, 2001.

(51) Int. Cl.
*A63H 3/02* (2006.01)

(52) U.S. Cl. ..... 446/369; 446/387

(58) Field of Classification Search ..... 446/369, 446/385, 387, 901, 380
See application file for complete search history.

(56) References Cited

U.S. PATENT DOCUMENTS

| | | | | | |
|---|---|---|---|---|---|
| 3,699,704 | A | | 10/1972 | Hakin | |
| 3,927,482 | A | | 12/1975 | Marcus | |
| 4,722,713 | A | | 2/1988 | Williams et al. | |
| 5,026,315 | A | * | 6/1991 | Chap | 446/372 |
| 5,027,457 | A | * | 7/1991 | Sweet | 5/640 |
| 5,067,925 | A | * | 11/1991 | West | 446/397 |
| 5,147,384 | A | * | 9/1992 | La Rocca | 606/234 |
| D337,385 | S | * | 7/1993 | Lussier | D24/194 |
| 5,279,514 | A | * | 1/1994 | Lacombe et al. | 446/297 |
| 5,344,355 | A | * | 9/1994 | Silverstein | 446/72 |
| 5,418,991 | A | * | 5/1995 | Shiflett | 5/650 |
| 5,437,070 | A | * | 8/1995 | Rempp | 5/636 |
| 5,480,340 | A | | 1/1996 | Bogar | |
| 5,522,849 | A | * | 6/1996 | Xiques et al. | 606/236 |
| 5,557,815 | A | * | 9/1996 | Mintz et al. | 5/636 |
| 5,897,421 | A | * | 4/1999 | Rink et al. | 446/369 |
| D409,755 | S | * | 5/1999 | Thorpe et al. | D24/195 |
| 5,908,439 | A | * | 6/1999 | Ford et al. | 606/234 |
| 5,951,360 | A | * | 9/1999 | Fearon et al. | 446/227 |
| 5,975,982 | A | | 11/1999 | Spector | |
| 6,038,720 | A | * | 3/2000 | Matthews et al. | 5/639 |
| 6,048,248 | A | * | 4/2000 | Ritchey | 446/71 |
| 6,055,687 | A | * | 5/2000 | Matthews | 5/636 |
| 6,299,501 | B1 | * | 10/2001 | Lynch | 446/73 |
| 6,464,556 | B1 | * | 10/2002 | Kohn | 446/376 |
| 6,666,740 | B1 | * | 12/2003 | Schneider | 446/72 |

* cited by examiner

*Primary Examiner*—Faye Francis
(74) *Attorney, Agent, or Firm*—Ramon L. Pizarro; Edwin H. Crabtree

(57) ABSTRACT

A soft toy that incorporates pacifiers into the shape of the toy. The toy includes a body made from a pair of planar sheets of a flexible material, the planar sheets having a perimeter that extends along an edge, and a soft, flexible filling. the filling being generally in the shape of the perimeter of the planar sheets. The sheets are connected to one another by way of a seam along a plane to form an enclosed space that covers the filling and results in the edges of the planar sheets are contained within the enclosed space. The connected sheets will create at least one area where a pair of sections of the seam converge towards one another at an angle of from 20 to 40 degrees, but preferably at an angle of about 25 to about 35 degrees. This connection will create an integral pacifier from the material of the toy. The pacifier portion will be nearly conical in shape.

4 Claims, 4 Drawing Sheets

TOY AND PACIFYING DEVICE FOR INFANTS

REFERENCE TO RELATED APPLICATIONS

This application claims the benefit of my provisional application having Ser. No. 60/326,433, filed Oct. 1, 2001, now abandoned.

BACKGROUND OF THE INVENTION (a) Field of the Invention

This invention generally relates to a flexible toy that provides components that allow the infant to chew on the device and also serves as a distraction device that pacifies the child. The device may include an internal musical component that cooperates with the sides of the toy so that the musical component can be easily activated by the child.

(b) Discussion of Known Art

It is well known that infant children can be amused by small stuffed animals or toys. The fabrication of these animals or toys has typically involved the assembly of various components that end up looking like the animal that is portrayed by the toy. For example, stuffed toy rabbits will include a head with large ears, a body and legs. The construction of such a toy will typically involve the use of several panels that are sown together to form the shape of the animal's body parts. A problem with this type of construction is that it can isolate the major parts of the body of the toy. This makes it difficult to effectively incorporate mechanisms such as electronic musical devices into the body of the toy. These musical devices must be inserted into the larger body portions of the toy, where sufficient room is found to accommodate the musical device. The placement of the musical device in these areas of the stuffed toy makes it difficult for an infant can squeeze the toy with sufficient force to allow the infant to trigger or activate the musical device.

Another problem associated with known stuffed toys is that they rely on the appearance of the toy as an attractant to get the child or infant to play with the toy. Thus, the accepted method for fabricating these toys involves creating a stuffed animal that looks like a real animal or a cartoon type character of such an animal. Infants, however, are not sufficiently familiar with animals or cartoon characters to appreciate the details of these types of toys. Therefore, the effectiveness of these toys as an attractant that distracts the child and thereby pacifying the child is limited in that they have been created from the perspective of a non-infant child or an adult that is familiar with these characters or animals.

Well known pacifier devices typically incorporate a rubber nipple portion that is instinctively chewed by the child. The shapes of these devices are designed to take advantage of this instinctive behavior by infants. Known stuffed animals, however, do not provide components that are designed to play on these instinctive impulses. For example, a stuffed rabbit may have floppy ears, but these ears do not incorporate the three dimensional features of the well-known pacifier.

Examples of stuffed toys and toys that use tethers and musical components can be found in U.S. Pat. No. 5,975,982 to Spector, issued Nov. 2, 1999, U.S. Pat. No. 5,480,340 to Bogar, issued Jan. 2, 1996, U.S. Pat. No. 5,478,268 to Au, issued Dec. 26, 1995, U.S. Pat. No. 4,756,109 to Marcus, issued Jul. 12, 1988, U.S. Pat. No. 4,722,713 to Williams et al., issued Feb. 2, 1988, U.S. Pat. No. 4,147,344 to Lee, issued Apr. 3, 1979, U.S. Pat. No. 3,699,704 to Hakim, issued Oct. 24, 1972, U.S. Pat. No. 3,927,482 to Marcus, issued Dec. 23, 1975. Examples of toys that include pacifiers are found in U.S. Pat. No. 5,665,113 to Decker et al. However, structure and geometry of these devices do not lend themselves to the use of the devices as pacifiers or teething devices. Furthermore, an infant's mind is constantly absorbing information on shapes and colors. Because the infant is learning to recognize shapes and colors, it would be advantageous to provide a device that can perform the functions of a pacifier and allow containment and activation of a musical component within the device. The activation of the musical component being in response to a tug or squeeze of the toy by the infant.

Still further, there remains a need for a device and method that can be used to help or teach infants in recognizing simple shapes, while also serving as a pacifier.

There remains a need for a device that includes bright colors and that can be serve as a pacifier as well as a tethered toy that can be carried by the child, tethered to the child's garment or body.

Therefore, a review of known devices reveals that there remains a need for a simple device that allows an infant to use the device as a teething device, a pacifier, a tethered toy, and an instructional device that can capture the attention of an infant.

SUMMARY

It has been discovered that the problems left unanswered by known art can be solved by providing a soft toy that includes:

a body made from a pair of planar sheets of a flexible material, the planar sheets having a perimeter that extends along an edge; and a soft, flexible filling, the filling being generally in the shape of the perimeter of the planar sheets. The sheets are connected to one another by way of a seam along a plane to form an enclosed space that covers the filling and results in the edges of the planar sheets are contained within the enclosed space. The connected sheets will create at least one area where a pair of sections of the seam converge towards one another at an angle of from 20 to 40 degrees, but preferably at an angle of about 25 to about 35 degrees. This connection will create an integral pacifier from the material of the toy. The pacifier portion will be nearly conical in shape.

The formation of the integral pacifier can be incorporated into several parts of the toy. In one example, the toy has a crescent shape that provides two areas where the seams converge towards one another. Another example uses these converging areas to create a toy figure with integral pacifier portions that create the outline of an animal, such as a bear or other quadruped. In still another example, the converging sections are used to create the outline of a star.

Since the converging areas need to be capable of serving as a pacifier, or even a teething device, it is contemplated that the entire device needs to be smaller than eight inches, and preferably of about three to four inches. These proportions will allow the formation of figures with sufficiently prominent pacifier sections so that the infant will notice the converging areas, or pacifier sections, and be drawn to them. It is also contemplated that in order to enhance the attraction, by way of curiosity or instinct, the planar sheets will include patterns created from bright, fluorescent colors.

It is also contemplated that a pressure activates musical device may be incorporated into the toy. The musical device would be held between the planar sheets, and preferably imbedded into the filling or batting material. Additionally, at least one tether could be added to the toy. It is contemplated that the tether could be incorporated into the seam joining the planar sheets. It has also been discovered that activation of the musical device is facilitated by placing the tether at this location. Pulling the toy against the tether causes the planar sheets to converge towards one another. This convergence squeezes any batting or filling around the musical device, activating the musical device or decreasing the amount of additional force needed to trigger the musical device.

Thus, it will be understood that the disclosed toy achieves new useful results that could not be achieved with known devices. Importantly, the disclosed toy captures an infant's attention, provides a pacifier function, and provides simple shape outlines to help infants recognize simple shapes. The shape recognition is accomplished by creation of an association of the simple shape and the pleasant or desirable attributes of the music and/or the pacifier.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
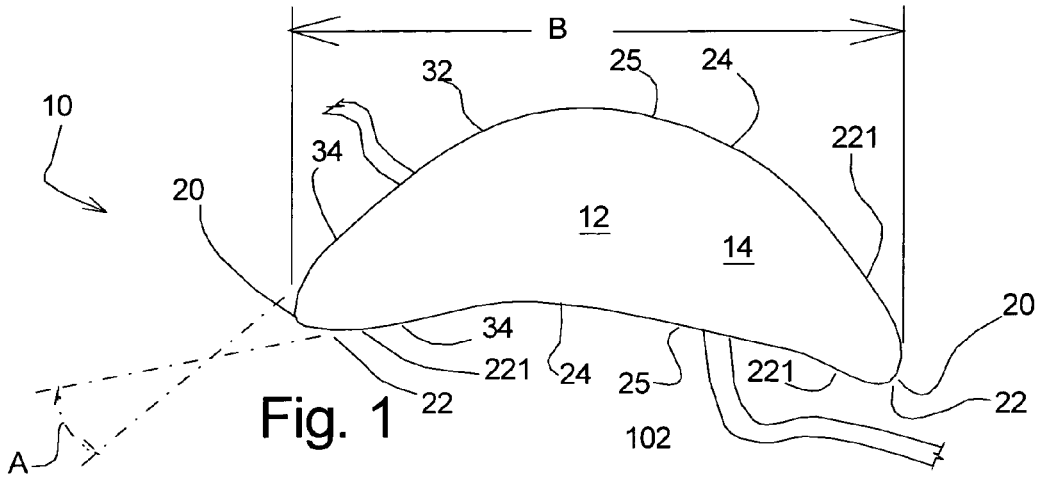
FIG. 1 is a plan view of one of one of the toys made from planar sheets having a perimeter that corresponds or follows the perimeter illustrated.
Figure 1A:
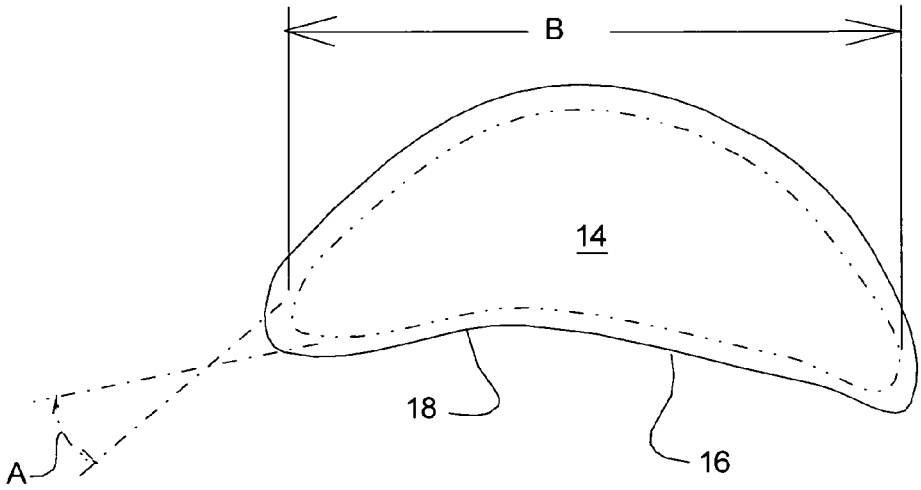
FIG. 1A is a plan view of one of the two sheets of planar material used to create the flexible toy.

Turning now to FIG. 1 where an example of a soft toy and pacifier 10 has been illustrated. The example of the soft toy and pacifier 10, or toy 10, includes a body 12 that has been made from a pair of planar sheets 14. The pair of planar sheets 14 have been illustrated in FIG. 1A. These planar sheets 14 should be of a flexible material, such as fabric, textiles or of a suitable synthetic material. It is advantageous that flexible material be capable of accepting or displaying patterns of bright, fluorescent colors. For example, it is contemplated that bright patterns with simple outlines may be used to create the patterns and attract the child's attention. Examples of suitable colors include fluorescent green, fluorescent yellow, and fluorescent red. All of these colors may be used in combination with black lines or section that break up the color patterns.

Figure 2:
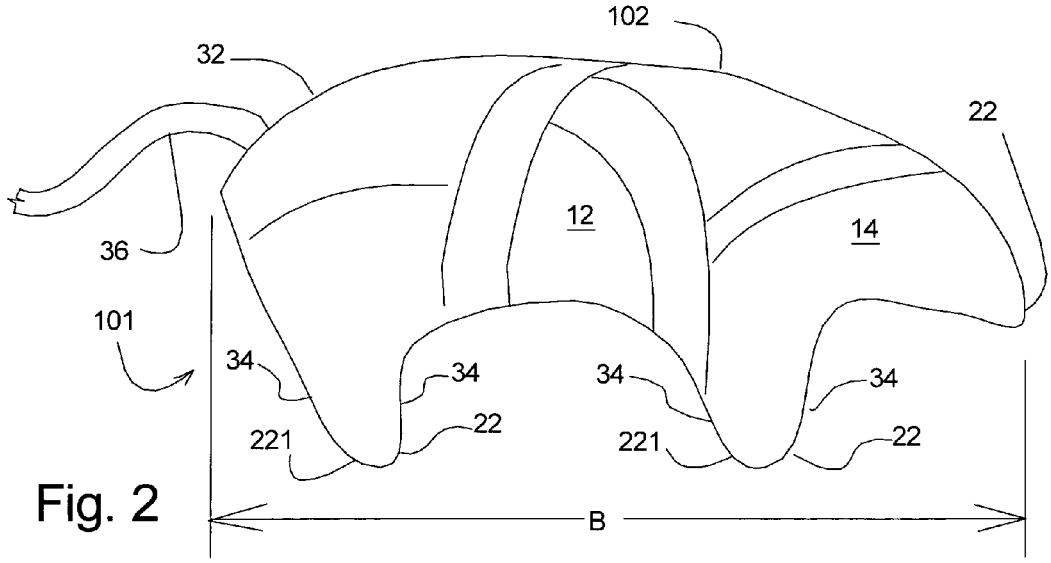
FIG. 2 is a plan view of another example of a toy made in accordance with the principles taught herein.
Figure 3:
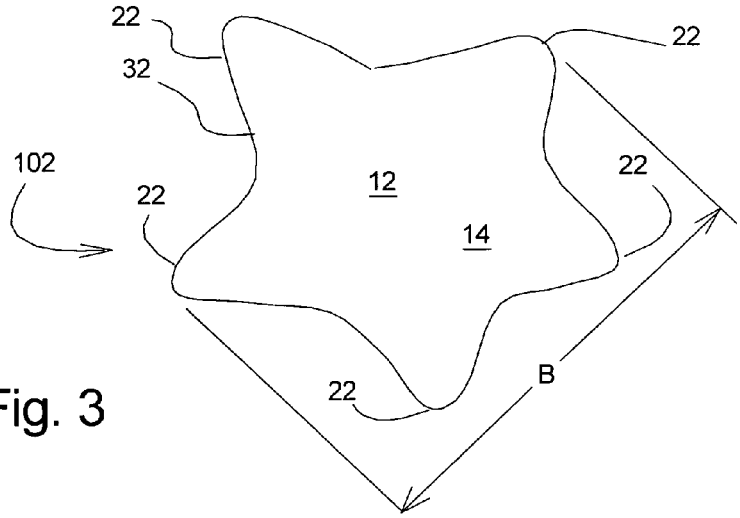
FIG. 3 is a plan view of a star-shaped toy created using the principles taught herein.

Also illustrated, is that it is contemplated that can each of the planar sheets 14 will have a similar perimeter 16. Each of the perimeter 16 terminate in an edge 18. In the accompanying illustrations, FIGS. 1, 2, and 3 illustrate examples of toys that have been made in accordance with the principles taught herein. These examples illustrate that the profile 18 of each toy 10 will be formed from concave, rounded sections that meet to form points 20, defining pacifier portions 22. Thus, the crescent shaped toy 10 is made from a pair of pacifier portions 22 that are spaced from one another and connected by gently curved sections 24 that create a single arc 25. Similarly, the quadruped shaped toy 101 illustrated in FIG. 2 is made from three pacifier portions 12, each connected by gradually rounded or gently curved sections 24. The quadruped shape toy 101 being defined by a pair of the pacifiers 221 extending in a generally parallel fashion from the body 23 an a third pacifier extending from body 23 at an angle to the pair of pacifiers 221 that extend from the body 23 in a generally parallel fashion. In still another example, illustrated in FIG. 3, a star shaped toy 102 has been illustrated. The star shaped toy 102 is made from five pacifier portions 12 joined together in a radial manner by smooth radii.

Figure 4:
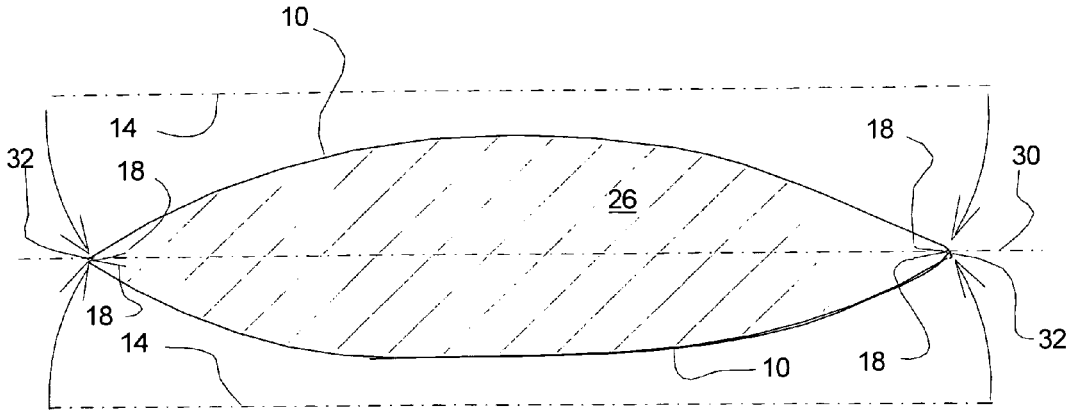
FIG. 4 is a sectional view taken from the location indicated on FIG. 1, and also illustrates the forming of the shape of the body of the toy by draping the planar sheets over the soft filling material.

Turning now to FIG. 4, it will be understood that the toy 10, in any of the configuration formed from the principles taught herein, will be formed by placing the planar sheets 14 on opposite sides of a section of batting material 26 or other soft, spongy, flexible filling material that would permit chewing by the infant. As illustrated, the sheets are extended around the filling and being connected to one another by way of a seam 28 formed by sowing, welding, glueing or joining by other methods. It is preferred that the seam 28 be created such that it joins the edges 18 along a plane 30 to form a body perimeter 32 that encloses the edges 18 of the sheets 14, capturing the edges within the body 12 and the body perimeter 32, including the sections of the seam that converge towards one another to form the pacifier portions 22.

Turning once again to FIGS. 1, 2, and 3, it will be understood that the pacifier portions 22 will be defined by generally straight sections 34 that converge towards one another at an angle "A" of from about 20 to 40 degrees, but preferably at an angle of about 25 to about 35 degrees. Additionally, it is contemplated that the dimension "B" will be from about two to six inches, and preferably from three to five inches, and most preferably of about four to four and a half inches. It has been found that these dimensions result in a proportionate toy that allows gripping and holding by infants, while allowing the needed transition proportions to produce the pacifier portions 22 and a recognizable animal outline or figure outline that can be easily recognized by infants.

The pacifier sections may be near a tether 36 that is incorporated at or near the seam 28. The tether allows mounting of the toy 10 from a child carrier or car-seat. Additionally, it is contemplated that a second tether 38 may be incorporated at an opposite location as the tether 36, preferably in or close to the seam 28. The use of the tethers in these locations allows support or suspension of the toy 10 at close proximity to the child's face, capturing the child's attention.

Figure 5:
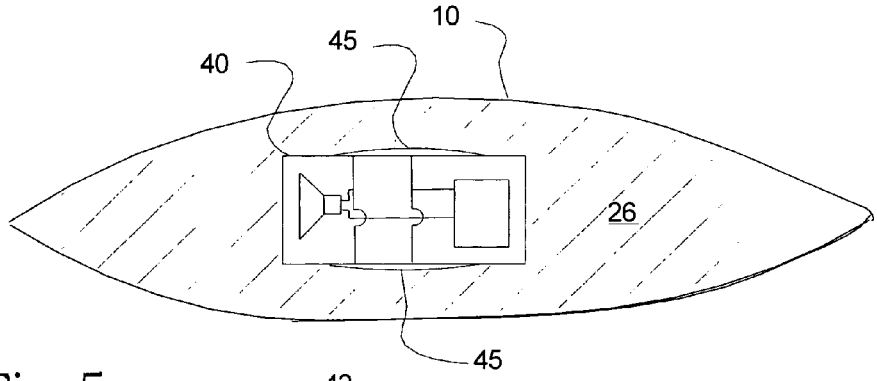
FIG. 5 is a section similar to FIG. 4, and illustrates the placement of a pressure actuated musical device.
Figure 6:
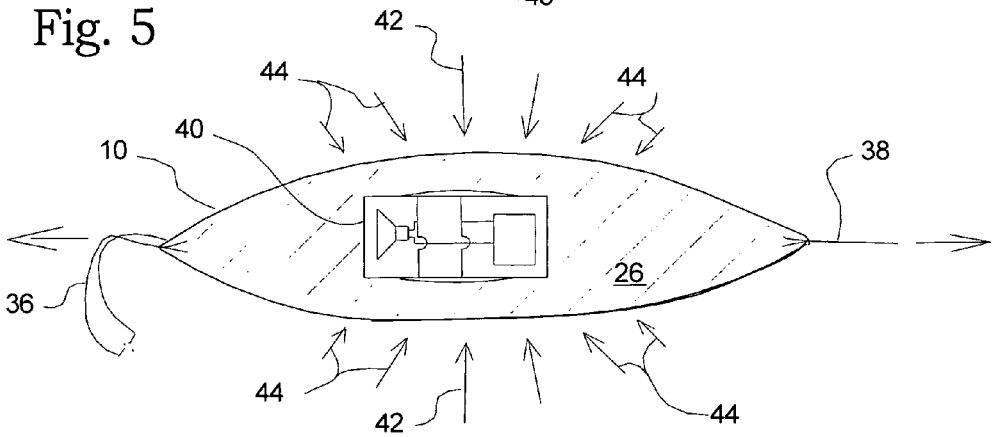
FIG. 6 is a section similar to FIG. 4, and illustrates the squeezing effect caused by the pulling on the tether or tethers used with the toy.
Figure 7:
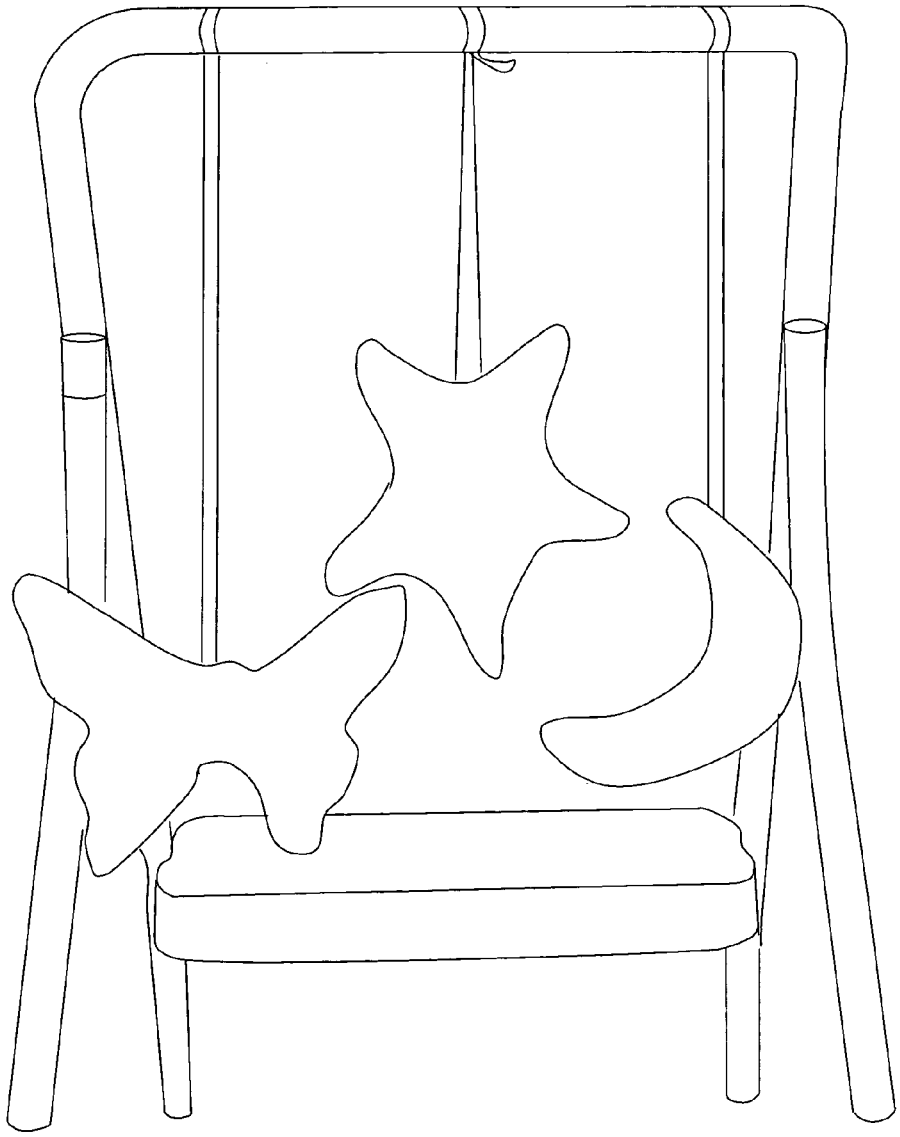

Turning now to FIGS. 5 and 6, it will be understood that it is contemplated that the toy 10 may include a hidden or imbedded musical device 40. The musical device 40 being actuated by sound or by pressure on the sides, over the sheets 14, of the toy 10. A pressure activated musical device 40 is activated by the imposition of a pressure force in the direction indicated by arrow 42. By tethering the toy from a seam area, a pull on the toy 10 will urge the sheets 14 to move towards one another in the direction of arrows 44. The urging of the sheets 14 in this manner reduces the amount of force needed to press the triggering mechanism 45 of the musical device 40, thus making it easier for the child to activate the mechanism. Additionally, the addition of the second tether 38 will allow the child to activate the musical device 40.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A soft toy and pacifier for aiding infants in recognizing simple shapes, the toy comprising:

a soft, flexible filling;

a body comprising a pair of planar sheets of a flexible material, each of the planar sheets having a similar perimeter, the perimeter terminating in an edge, the sheets extending around the filling and being connected to one another by way of a seam that joins the edges along a plane to form a body perimeter that encloses the edges, the body perimeter including sections of the seam that converge towards one another at an angle of from 20 to 40 degrees to create an approximately conical section defining a pacifier;

a pressure activated musical device, said musical device being positioned along the plane between the pair of planar sheets of flexible material;

a tether, the tether being positioned opposite to the conical section defining said pacifier, so that when the toy is suspended by the tether a pull on the conical section defining said pacifier causes the pressure activated musical device to be squeezed by the panels thereby activating the pressure activated musical device.

2. A toy according to claim 1 wherein said body perimeter is generally crescent shaped, the crescent shape being defined by a pair of pacifiers with said body extending between the pair of pacifiers in as a single arc, and said tether is attached from one of said pacifiers.

3. A toy according to claim 1 wherein said body perimeter is generally star shaped, the star shape being defined by a plurality of said pacifiers extending from said body in a generally radial manner, and said tether is attached from one of said pacifiers.

4. A toy according to claim 1 wherein said body perimeter is shaped creating an outline of a quadruped shape, the quadruped shape being defined by a pair of said pacifiers extending in a generally parallel fashion from said body a third pacifier extending from said body at an angle to the pair of pacifiers that extend from the body in a generally parallel fashion, and said tether is attached opposite to one of said pacifiers.

* * * * *